US009443478B2

(12) United States Patent
Min et al.

(10) Patent No.: US 9,443,478 B2
(45) Date of Patent: Sep. 13, 2016

(54) LIGHT SOURCE DEVICE, DRIVING METHOD THEREOF AND DISPLAY DEVICE HAVING THE SAME

(71) Applicant: Samsung Display Co., LTD., Yongin, Gyeonggi-Do (KR)

(72) Inventors: Byung-Kyou Min, Seoul (KR); Won-Hyoung Kang, Asan-si (KR); Song-Yi Han, Asan-si (KR)

(73) Assignee: Samsung Display Co., Ltd. (KR)

( * ) Notice: Subject to any disclaimer, the term of this patent is extended or adjusted under 35 U.S.C. 154(b) by 91 days.

(21) Appl. No.: 14/567,952

(22) Filed: Dec. 11, 2014

(65) Prior Publication Data

US 2016/0042699 A1 Feb. 11, 2016

(30) Foreign Application Priority Data

Aug. 6, 2014 (KR) ..... 10-2014-0100967

(51) Int. Cl.
*H05B 37/02* (2006.01)
*G09G 3/34* (2006.01)

(52) U.S. Cl.
CPC ..... *G09G 3/3413* (2013.01); *G09G 3/3406* (2013.01); *G09G 2310/0235* (2013.01); *G09G 2320/0233* (2013.01); *G09G 2320/064* (2013.01); *G09G 2330/025* (2013.01)

(58) Field of Classification Search
CPC ..... H05B 33/0827; G09G 2320/0233; G09G 2320/064
USPC ..... 315/295, 297
See application file for complete search history.

(56) References Cited

U.S. PATENT DOCUMENTS

| | | | | |
|---|---|---|---|---|
| 7,518,319 | B2 | 4/2009 | Konno et al. | |
| 2009/0128055 | A1* | 5/2009 | Shin | H05B 33/0818 315/301 |
| 2011/0148323 | A1* | 6/2011 | Yao | H05B 33/0827 315/295 |
| 2011/0248648 | A1* | 10/2011 | Liu | G09G 3/3406 315/294 |
| 2013/0249420 | A1* | 9/2013 | Lee | H05B 33/0827 315/192 |
| 2014/0015425 | A1* | 1/2014 | Kraft | H05B 33/0836 315/185 R |
| 2014/0062314 | A1* | 3/2014 | Moskowitz | H05B 33/0827 315/185 R |
| 2014/0252965 | A1* | 9/2014 | Pope | H02M 3/04 315/185 R |
| 2015/0256071 | A1* | 9/2015 | Penzo | H02M 3/1582 315/297 |

FOREIGN PATENT DOCUMENTS

| | | |
|---|---|---|
| KR | 10-2009-0095135 | 9/2009 |
| KR | 10-2011-0052876 | 5/2011 |
| KR | 10-2011-0068363 | 6/2011 |

* cited by examiner

*Primary Examiner* — Don Le
(74) *Attorney, Agent, or Firm* — Innovation Counsel LLP

(57) ABSTRACT

A light source device capable of preventing luminance from being decreased, a driving method of the light source device and a display device having the light source device are disclosed. Alight source device includes a plurality of light-emitting diode ("LED") strings and an LED driving circuit. The LED strings include LEDs emitting lights connected in serial. The LED driving circuit supplies a driving voltage to the LED strings. The LED driving circuit maximizes the driving voltage supplied to the LED strings by using the minimum string current of string currents supplied to each LED string in an initial driving period. The LED driving circuit supplies the maximum driving voltage to the LED strings by blocking a current flowing through a sensing resistor disposed to sense the minimum string current in a normal driving period.

20 Claims, 6 Drawing Sheets

LIGHT SOURCE DEVICE, DRIVING METHOD THEREOF AND DISPLAY DEVICE HAVING THE SAME

This application claims priority to Korean Patent Application No. 10-2014-0100967, filed on Aug. 6, 2014, and all the benefits accruing therefrom under 35 U.S.C. §119, the content of which in its entirety is herein incorporated by reference.

BACKGROUND

1. Field

Exemplary embodiments of the inventive concept relate to a light source device, a driving method of the light source device and a display device having the light source device. More particularly, exemplary embodiments of the inventive concept relate to a light source device capable of preventing luminance from being decreased, a driving method of the light source device and a display device having the light source device.

2. Description of the Related Art

Generally, liquid crystal display ("LCD") devices have thinner thickness, lighter weight, and lower power consumption than other types of display devices. Thus, LCD devices are being widely used not only for monitors, notebook computers, and cellular phones, but also for wide-screen televisions. An LCD device includes an LCD panel displaying images using the light transmissivity property of a liquid crystal layer, and a backlight assembly providing the LCD panel with light.

The backlight assembly includes a light source that generates light. For example, the light source may be a cold cathode fluorescent lamp ("CCFL") or a light-emitting diode ("LED"). The LED is used as a light source for an LCD panel, because the LED has low power consumption and high color reproducibility.

Plural LEDs are coupled in series to define an LED string, and the LEDs are emitted by a driving current according to a suitable driving voltage by a control of an LED driving circuit. When the driving voltage is greater than necessary, unnecessary power consumption is generated. When the driving voltage is excessively small, it is difficult to supply a stable current due to a forward voltage variation of each LED. Thus, an LED driving circuit which removes unnecessary power consumption and can supply a suitable current is required.

In order to supply a suitable current, the LED driving circuit adjusts an average current flows through the LED strings by adjusting a duty cycle of a transistor connected to end terminals of LED strings based on an LED current measured per LED strings. However, when the luminance variation of LED becomes great, the luminance of the LCD device decreases greatly.

SUMMARY

Exemplary embodiments of the inventive concept provide a light source device capable of preventing luminance from being decreased even though an LED variation is great.

Exemplary embodiments of the inventive concept also provide a driving method of the above-mentioned light source device.

Exemplary embodiments of the inventive concept further also provide a display device having the above-mentioned light source device.

According to an exemplary embodiment of the inventive concept, a light source device includes a plurality of light-emitting diode ("LED") strings and an LED driving circuit. The LED strings include LEDs emitting lights connected in serial. The LED driving circuit supplies a driving voltage to the LED strings. The LED driving circuit maximizes the driving voltage supplied to the LED strings by using the minimum string current of string currents supplied to each LED string in an initial driving period. The LED driving circuit supplies the maximum driving voltage to the LED strings by blocking a current flowing through a sensing resistor disposed to sense the minimum string current in a normal driving period.

In an exemplary embodiment of the inventive concept, the LED driving circuit includes a voltage generating part, a plurality of string selecting parts, and a scanning feedback part. The voltage generating part may provide each first terminal of the LED strings with the driving voltage. The string selecting part may be connected to each second terminal of the LED strings to sequentially select the LED string. The scanning feedback part may detect string currents supplied to each of the LED strings sequentially selected and configured to control the voltage generating part to output the maximum driving voltage by using the minimum string current.

In an exemplary embodiment of the inventive concept, the string selecting part may include a plurality of string selecting portions, each string selecting portion may include a first differential amplifier, a first metal-oxide-semiconductor field effect transistor ("MOSFET"), a voltage storage part, a voltage storage control part, and a reference voltage setting part. The first MOSFET may include a gate connected to an output terminal of the first differential amplifier, a source connected to a ground terminal, and a drain connected to the LED string. The voltage storage part may store drain voltage information of the first MOSFET. The voltage storage control part may control that the drain voltage information of the power MOSFET is stored in the voltage storing part in an initial driving period. The reference voltage setting part may set drain voltage information of the first MOSFET as a new reference voltage, which is stored in the voltage storing part in a normal driving period.

In an exemplary embodiment of the inventive concept, the voltage storage control part may include a first field effect transistor ("FET"), a second FET, and a third FET. The first FET may include a drain receiving a sensing current, a gate receiving a scanning control signal provided from device light source control part, and a source connected to an inverting input of the differential amplifier. The first FET may supply a voltage corresponding to a sensing current to the inverting input of the first differential amplifier in response to a scanning control signal of a high level. The second FET may include a source connected to the reference voltage setting part, a drain commonly connected to a second terminal of the LED string and a drain of the first MOSFET, and a gate receiving the scanning control signal. The second FET may store drain voltage information of the first MOSFET in the voltage storing part in response to a scanning control signal of a high level. The third FET may include a drain receiving an initial reference voltage provided from the light source control part, a gate receiving the scanning control signal, and a source connected to a non-inverting input of the first differential amplifier. The third FET may supply the initial reference voltage to the non-inverting input of the first differential amplifier in response to a scanning control signal of a high level.

In an exemplary embodiment of the inventive concept, the reference voltage setting part may include a fourth FET, a fifth FET, a first inverter, and a second inverter. The fourth FET includes a drain commonly connected to a source of the first FET and the inverting input of the first differential amplifier, a source connected to the source of the second FET, and a gate connected to an output terminal of the first inverter. The fifth FET may include a source commonly connected to the source of the third FET and the non-inverting input of the first differential amplifier, and a drain commonly connected to the drain of the second FET, the second terminal of the LED string and the drain of the first MOSFET. The first inverter inverts the scanning control signal and outputs the inverted scanning control signal to a gate of the fourth FET. The second inverter inverts the scanning control signal and outputs the inverted scanning control signal to the gate of the fifth FET.

In an exemplary embodiment of the inventive concept, when the scanning control signal is a low level, a signal of a high level inverted by the first inverter may turn-on the fourth FET, so that a voltage stored in the voltage storing part may be supplied to the inverting input of the first differential amplifier.

In an exemplary embodiment of the inventive concept, when the scanning control signal is a low level, a signal of a high level inverted by the second inverter may turn-on the fifth FET, so that a drain voltage of the first MOSFET may be supplied to the non-inverting input of the first differential amplifier.

In an exemplary embodiment of the inventive concept, the sensing resistor may be disposed between the voltage generating part and the LED string to convert amplitude of a current into a voltage. The scanning feedback part may include a second differential amplifier, inputs of the second differential amplifier being connected to two terminals of the sensing resistor to amplify a difference voltage between a voltage outputted from the voltage generating part and a voltage passing the sensing resistor and to control the voltage generating part to output the maximum voltage by using the amplified difference voltage.

In an exemplary embodiment of the inventive concept, the scanning feedback part may further include a switch connected to the two terminals of the sensing resistor to be opened before a normal current is respectively supplied to the LED strings and to be closed when the normal current is respectively supplied to the LED strings. A driving voltage outputted from the voltage generating part may be supplied to the LED strings through the sensing resistor during an initial driving period which is a period for detecting a current value of each LED string before a normal driving period. The driving voltage outputted from the voltage generating part may be supplied to the LED strings through the switch during the normal driving period to cause the LED strings to turn-on to emit light.

In an exemplary embodiment of the inventive concept, the scanning feedback part may include a current sensing part, an analog-digital converter, a minimum value selecting part, a digital-analog converter, and a feedback part. The current sensing part may sense string currents supplied to the LED strings from the voltage generating part. The analog-digital converter may convert the currents sensed by the current sensing part into digital sensed currents. The minimum value selecting part may select a minimum string current of the digital sensed currents. The digital-analog converter may convert the minimum string current selected by the minimum value selecting part into an analog string current. The feedback part may adjust a level of a driving voltage outputted from the voltage generating part, based on the analog string current converted by the digital-analog converter, to control a constant voltage.

In an exemplary embodiment of the inventive concept, the sensing resistor may be disposed between the voltage generating part and the LED string to convert amplitude of a current into a voltage. The current sensing part may include a second differential amplifier comprising an inverting input receiving a voltage corresponding to a current inputted through the sensing resistor, a non-inverting input receiving a voltage corresponding to a current outputted from the sensing resistor and an output terminal outputting an amplified differential voltage to the analog-digital converter.

In an exemplary embodiment of the inventive concept, the analog-digital converter may include a first error amplifier, a first RS flip-flop, and a counter. The first error amplifier may include an inverting input connected to an output terminal of the second differential amplifier and a non-inverting input receiving a saw tooth waveform signal. The first RS flip-flop may include a reset terminal connected to an output terminal of the first error amplifier and a set terminal receiving a clock signal. The counter counts a status signal outputted from the first RS flip-flop to output a count value to the minimum value selecting part.

In an exemplary embodiment of the inventive concept, the minimum value selecting part may compare with a previous count value and a current count value to provide the digital-analog converter with a minimum count value.

In an exemplary embodiment of the inventive concept, the feedback part may include a second error amplifier, a second RS flip-flop, a second power MOSFET, and a pull-down resistor. The second error amplifier may include an inverting input connected to an output terminal of the digital-analog converter, and a non-inverting input receiving a saw tooth waveform signal. The second RS flip-flop may include a reset terminal connected to an output terminal of the second error amplifier, and a set terminal receiving a clock signal. The second MOSFET may include a gate connected to Q terminal of the second flip-flop and a drain connected to the voltage generating part. The pull-down resistor may include a first terminal connected to a source of the second MOSFET and a second terminal connected to a ground terminal.

According to another exemplary embodiment of the inventive concept, there is provided a method of driving a light source device comprising a voltage generating part and a plurality of light-emitting diode ("LED") strings in which LEDs emitting lights in response to an output voltage of the voltage generating part are connected in serial. The method includes in an initial driving period, maximizing a driving voltage supplied to the LED strings by using a minimum string current information of string currents respectively supplied to the LED strings, and in a normal driving period, blocking a current flowing through a sensing resistor disposed to sense the minimum string current to supply the maximum driving voltage to the LED strings.

In an exemplary embodiment of the inventive concept, the maximizing the driving voltage may include regulating each of the LED strings at a normal current to obtain a feedback current information; selecting the minimum feedback current information of the feedback current information; and fixing an output voltage of the voltage generating part in response to the minimum feedback current information.

In an exemplary embodiment of the inventive concept, the maximizing the driving voltage may further include regulating each of the LED strings to a normal current in accordance with the fixed output voltage and obtaining feedback current information; selecting the minimum feedback current information of the obtained feedback current information; and fixing an output voltage of the voltage generating part based on the selected minimum feedback current information.

In an exemplary embodiment of the inventive concept, each string current of the LED strings regulated to a normal current may be converted into string current data of a digital value. The minimum feedback current information may be selected from the plural string current data.

In an exemplary embodiment of the inventive concept, the minimum feedback current information may be selected by comparing with a first sensing voltage corresponding to a string current of N-th LED string and a second sensing voltage corresponding to a string current of (N+1)-th LED string, wherein 'N' is a natural number. A phase of the first sensing voltage may be shifted to have a same phase of the second sensing voltage.

According to another exemplary embodiment of the inventive concept, a display device includes a display panel and a light source device. The light source device provides the display panel with lights. The light source device includes a plurality of light-emitting diode ("LED") strings and an LED driving circuit. The LED strings include LEDs emitting lights connected in serial. The LED driving circuit supplies a driving voltage to the LED strings. The LED driving circuit maximizes the driving voltage supplied to the LED strings by using the minimum string current of string currents supplied to each LED string in an initial driving period. The LED driving circuit supplies the maximum driving voltage to the LED strings by blocking a current flowing through a sensing resistor disposed to sense the minimum string current in a normal driving period.

According to a light source device, a driving method of the light source device and a display device having the light source device, it maximizes a driving voltage supplied to the LED strings by using the minimum string current of the string current supplied to each of the LED strings in an initial driving period, so that it is capable of preventing luminance from being decreased even though an LED variation is great.

BRIEF DESCRIPTION OF THE DRAWINGS

The above and other features of the inventive concept will become more apparent by describing in detailed exemplary embodiments thereof with reference to the accompanying drawings, in which.

DETAILED DESCRIPTION

Hereinafter, the inventive concept will be described in detail with reference to the accompanying drawings.

Figure 1:
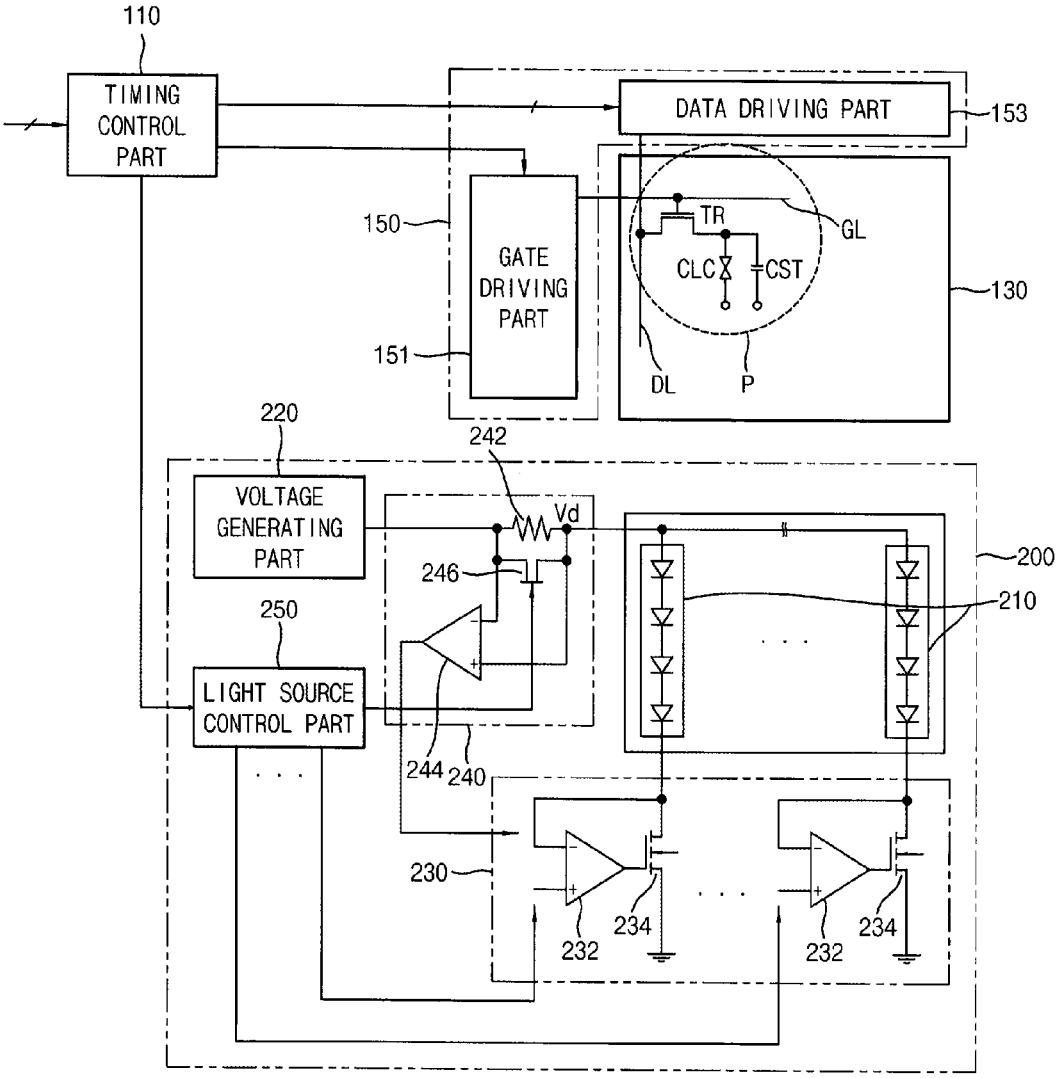
FIG. 1 is a block diagram explaining a display device according to an exemplary embodiment of the inventive concept.

FIG. 1 is a block diagram explaining a display device according to an exemplary embodiment of the inventive concept.

Referring to FIG. 1, a display device includes a timing control part 110, a display panel 130, a panel driving part 150 and a light source device 200.

The timing control part 110 receives a control signal and an image signal from an external device (not shown). The timing control part 110 generates a timing control signal controlling a driving timing of the display device by using the control signal. The timing control signal may include a clock signal, a horizontal start signal and a vertical start signal.

The display panel 130 includes a plurality of pixels P. Each of the pixels P may include a switching element TR connected to a gate line GL and a data line DL, a liquid crystal capacitor CLC electrically connected to the switching element TR and a storage capacitor CST electrically connected to the switching element TR.

The panel driving part 150 includes a gate driving part 151 and a data driving part 153. The gate driving part 151 outputs a gate signal to the gate line GL by using a timing control signal provided from the timing control part 110. The data driving part 153 outputs a data signal to the data line DL by using a timing control signal and an image signal provided from the timing control part 110.

The light source device 200 includes a plurality of LED strings 210, a voltage generating part 220, a string selecting part 230, a scanning selecting part 240 and a light source control part 250. In an exemplary embodiment, an LED driving circuit may include the voltage generating part 220, the string selecting part 230, the scanning selecting part 240 and the light source control part 250. The LED driving circuit supplies a driving voltage to the LED strings 210. The LED driving circuit maximizes the driving voltage supplied to the LED strings 210 by using the minimum string current of the string current supplied to each of the LED strings 210 in an initial driving period which is a period for detecting a current value of each LED string before a normal driving period which is a period following the initial driving period to cause the LED strings to turn-on to emit light. Moreover, the LED driving circuit blocks a current flowing through a sensing resistor disposed to sense the minimum string current in a normal driving period, thereby supplying the maximum driving voltage to the LED strings 210.

Each of the LED strings 210 includes plural LEDs connected in serial to emit lights. The LED strings 210 are connected to each other in parallel. First terminals of the LED strings 210 are commonly connected to the voltage generating part 220 through the scanning feedback part 240, and second terminals of the LED strings 210 are connected to the string selecting part 230. Although not shown in FIG. 1, the light source device 200 may further include a printed circuit board having the LED strings 210 mounted thereon.

The voltage generating part 220 boosts or reduces voltage supplied from an external device to generate a first driving voltage 'VIN' for driving the LED strings 210, and provides a second driving voltage 'Vd' which is less than the first driving voltage VIN to each of the first terminals of the LED strings. For example, the voltage generating part 220 may be a DC/DC converter which boosts a direct voltage supplied from an external device.

The string selecting part 230 includes a first differential amplifier 232 connected to each second terminal of the LED strings 210 and a first power metal-oxide-semiconductor field effect transistor (which will be hereinafter referred to as a power MOSFET). The string selecting part 230 sequentially selects the LED strings 210 in response to an initial driving signal provided from the light source control part 250. A detailed description of the string selecting part 230 will be described later.

The scanning feedback part 240 includes a sensing resistor 242, a second differential amplifier 244 and a switch 246. The scanning feedback part 240 detects a current of a selected LED string selected by string selecting part 230. The scanning feedback part 240 controls the voltage generating part 220 by using a minimum string current of the string currents, so that the voltage generating part 220 outputs the maximum driving voltage. Thus, the voltage generating part 220 outputs a constant voltage.

The sensing resistor 242 is disposed between the voltage generating part 220 and the LED string to detect electrical current flow through the sensing resistor 242. The sensing resistor 242 may include a current shunt resistor which is low resistance precision resistor used to measure AC or DC electrical currents by the voltage drop across the resistance. A string current flowing through the sensing resistor 242, that is a string current supplied to the LED string, is converted into a voltage by the equation V=IR, so that the converted voltage may be monitored by a second differential amplifier 244.

Two inputs of the second differential amplifier 244 is connected to two end terminals of the sensing resistor 242 to amplify a differential voltage between a voltage outputted from the voltage generating part 220 and a voltage passing the sensing resistor 242. The output of the second differential amplifier 244 is supplied to the string selecting part 230. The second differential amplifier 244 controls the string selecting part 230 by using the amplified differential voltage, so that the voltage generating part 220 outputs the maximum voltage.

The switch 246 is connected between two end terminals of the sensing resistor 242. The switch 246 is opened during the initial driving period, and is closed during the normal driving period in which the driving current is provided to each of the LED strings 210. Thus, a driving voltage outputted from the voltage generating part 220 is supplied to the LED strings 210 through the sensing resistor 242 during the initial driving period. During the normal driving period, a driving voltage outputted from the voltage generating part 220 is supplied to the LED strings 210 through the switch 246. The switch 246 may be a junction field effect transistor ("J-FET").

A detailed description of the scanning selecting part 240 will be described later.

The light source control part 250 controls an operation of the string selecting part 230 and an operation of the scanning feedback part 240 in response to a control of the timing control part 110.

In an exemplary embodiment, in the initial driving period that a constant voltage is not provided to the LED strings 210, the light source control part 250 activates an operation of the string selecting part 230 so that the LED strings 210 are sequentially selected.

In the normal driving period, the light source control part 250 stops an operation of the scanning feedback part 240 and an operation of the string selecting part 230.

In an exemplary embodiment, the light source control part 250 is disposed in the light source device 200. Alternatively, the light source control part 250 may be disposed in an external device.

Figure 2:
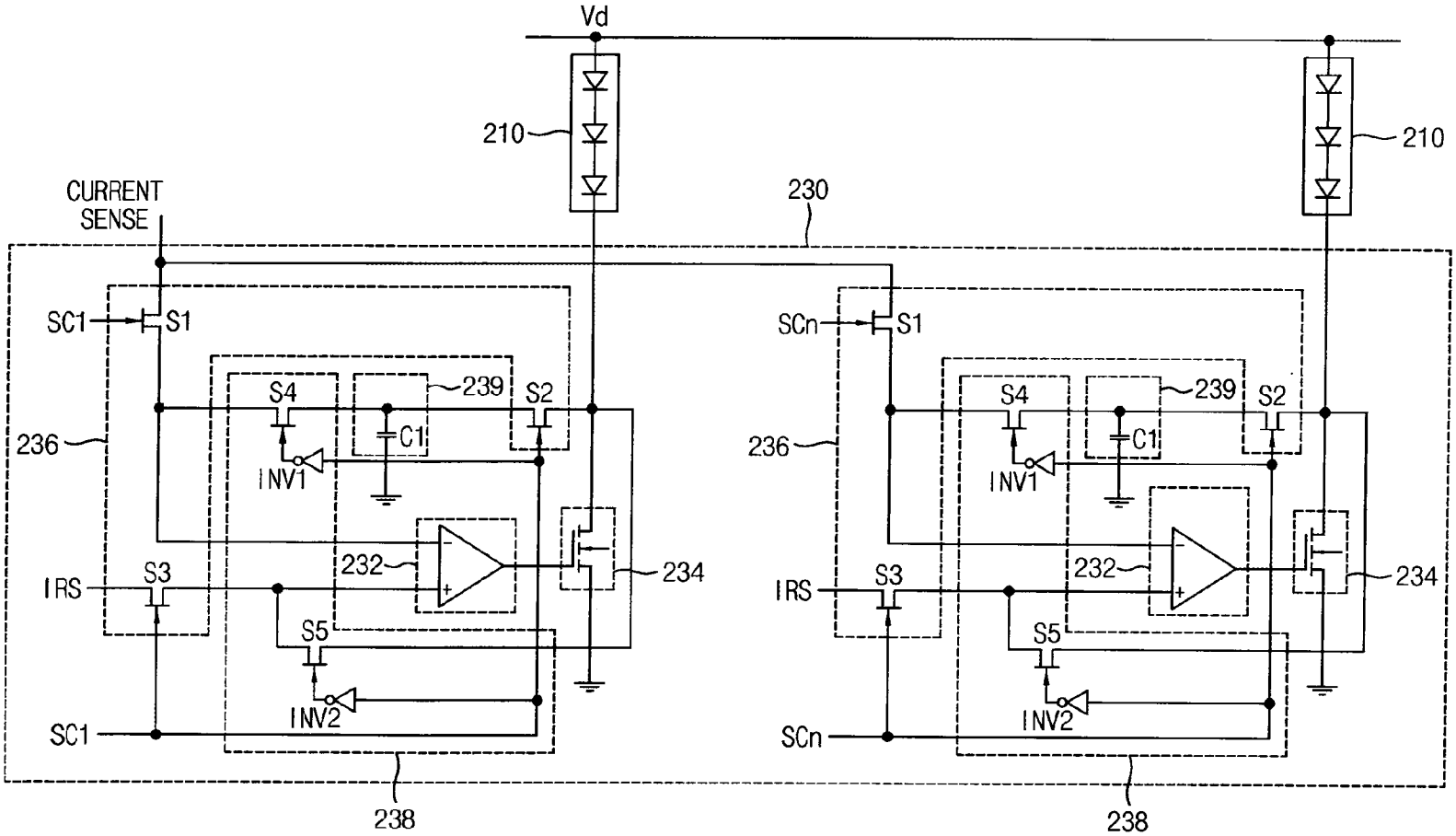
FIG. 2 is a circuit diagram explaining an example of a string selecting part shown in FIG. 1.

FIG. 2 is a circuit diagram explaining an example of a string selecting part 230 shown in FIG. 1.

Referring to FIGS. 1 and 2, a string selecting part 230 connected to the LED strings 210 includes a plurality of string selecting portions. Each string selecting portion includes a first differential amplifier 232, a first power MOSFET 234, a voltage storage control part 236, a reference voltage setting part 238 and a voltage storage part 239. Hereinafter, a string selecting portion connected to a first LED string will be described.

The first differential amplifier 232 includes an inverting input connected to the voltage storage control part 236, a non-inverting input connected to the reference voltage setting part 238 and an output terminal connected to a gate of the first power MOSFET 234.

The first power MOSFET 234 includes a gate connected to an output terminal of the first differential amplifier 232, a drain connected to the LED string 210 and a source connected to a ground terminal In an exemplary embodiment, the first power MOSFET 234 may be an N-channel FET (field effect transistor).

The voltage storage control part 236 includes a first J-FET S1, a second J-FET S2 and a third J-FET S3. In the initial driving period, the voltage storage control part 236 controls that drain voltage of the first power MOSFET 234 is stored in the voltage storing part 239. In an exemplary embodiment, each of the first J-FET S1, the second J-FET S2 and the third J-FET S3 may be an N-channel FET.

The first J-FET S1 includes a drain receiving a sensing current provided from the second differential amplifier 244 and a gate receiving a scanning control signal SC1 provided from the light source control part 250. When the scanning control signal SC1 is a high level, the first J-FET S1 is turned-on to supply a voltage corresponding to a sensing current to an inverting input of the first differential amplifier 232.

The second J-FET S2 includes a source connected to the reference voltage setting part 238, a drain commonly connected to a second terminal of the LED string 210 and a drain of the first power MOSFET 234, and a gate receiving the scanning control signal SC1 provided from the light source control part 250. The second J-FET S2 is turned-on when the scanning control signal SC1 has a high level, so that a voltage of a second terminal of the LED string 210 is stored in the voltage storing part 239.

The third J-FET S3 includes a drain receiving an initial reference voltage IRS provided from the light source control part 250, a gate receiving the scanning control signal SC1, and a source connected to a non-inverting input of the first differential amplifier 232. The third J-FET S3 is turned-on when the scanning control signal SC1 is a high level, so that an initial reference voltage IRS is supplied to the non-inverting input of the first differential amplifier 232.

The reference voltage setting part 238 includes a fourth J-FET S4, a fifth J-FET S5, a first inverter INV1 and a second inverter INV2. In a normal driving period, the reference voltage setting part 238 sets drain voltage information of the first power MOSFET 234 as a new reference voltage, which is stored in the voltage storing part 239. In an exemplary embodiment, each of the fourth J-FET S4 and the fifth J-FET S5 may be an N-channel FET.

The fourth J-FET S4 includes a drain commonly connected to a source of the first J-FET S1 and an inverting input of the first differential amplifier 232, a source commonly connected to a source of the second J-FET S2, and a gate connected to an output terminal of the first inverter INV1.

The fifth J-FET S5 includes a source commonly connected to a source of the third J-FET S3 and a non-inverting input of the first differential amplifier 232, and a drain commonly connected to a drain of the second J-FET S2, a second terminal of the LED string 210 and a drain of the first power MOSFET 234.

The first inverter INV1 includes an input terminal receiving the scanning control signal SC1 provided from the light source control part 250, and an output terminal connected to a gate of the fourth J-FET S4.

The second inverter INV2 includes an input terminal receiving the scanning control signal SC1 provided from the light source control part 250, and an output terminal connected to a gate of the fifth J-FET S5.

When the scanning control signal SC1 has a low level, a signal of a high level inverted by the first inverter INV1 is supplied to a gate of the fourth J-FET S4 so that the fourth J-FET S4 is turned-on. Thus, a voltage stored in the voltage storing part 239 is supplied to a converting input of the first differential amplifier 232.

When the scanning control signal SC1 has a low level, a signal of a high level inverted by the second inverter INV2 is supplied to a gate of the fifth J-FET S5 so that the fifth J-FET S5 is turned-on. Thus, a drain voltage of the first power MOSFET 234 is supplied to a positive polarity terminal of the first differential amplifier 232.

The voltage storing part 239 includes a first capacitor C1 to store drain voltage information of the first power MOSFET 234. A first terminal of the first capacitor C1 is commonly connected to a source of the fourth J-FET S4 and a source of the second J-FET S2, and a second terminal of the first capacitor C1 is connected to a ground terminal The drain voltage information stored in the first capacitor C1 becomes new reference voltage, so that a drain voltage of the first power MOSFET 234 is maintained to be the same voltage stored in the first capacitor C1.

In an exemplary embodiment, the first J-FET S1, the second J-FET S2,the third J-FET S3,the fourth J-FET S4,the fifth J-FET S5,the first capacitor C1,the first inverter INV1, the second inverter INV2 and the first differential amplifier 232 except the first power MOSFET 234 may be integrated in one chip. The first J-FET S1, the second J-FET S2, the third J-FET S3, the fourth J-FET S4 and the fifth J-FET S5 may be a switch having three terminals, for example, bipolar transistors or MOS transistors.

Hereinafter, an operation of the string selecting part 230 will be described.

When a scanning control signal SC1 SCn of a high level is supplied from the light source control part 250 in an initial driving period, the first J-FET S1, the second J-FET S2 and the third J-FET S3 are turned-on, and the fourth J-FET S4 and the fifth J-FET S5 are turned-off Accordingly, a drain voltage of the first power MOSFET 234 is stored in the first capacitor C1.

When the scanning control signal SC1 SCn is dropped from a high level to a low level, the first J-FET S1, the second J-FET S2 and the third J-FET S3 are turned-off, and the fourth J-FET S4 and the fifth J-FET S5 are turned-on. Accordingly, the voltage information stored in the first capacitor C1 is set as a new reference voltage, so that a drain voltage of the first power MOSFET 234 is maintained to be the same voltage stored in the first capacitor C1.

Figure 3:
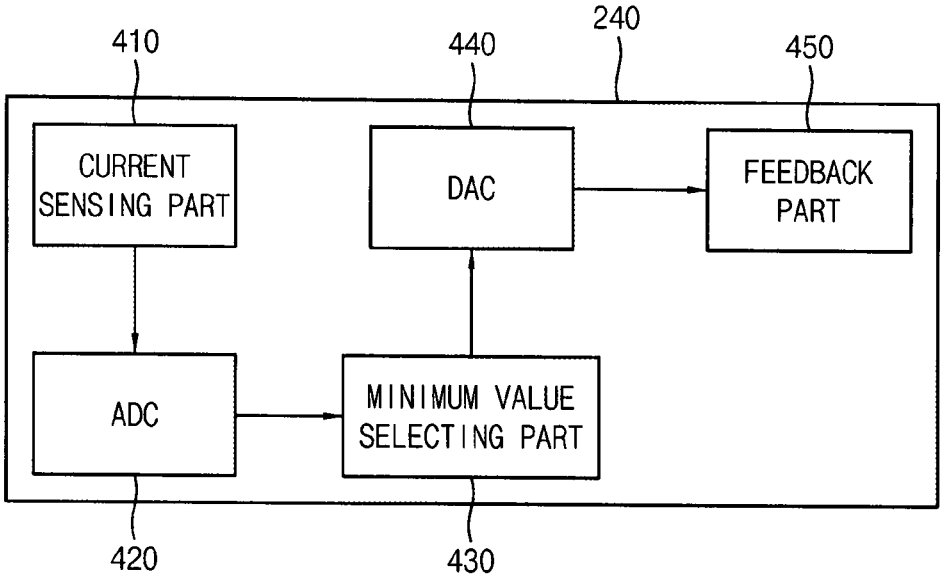
FIG. 3 is a block diagram explaining an example of a scanning feedback part shown in FIG. 1.

FIG. 3 is a block diagram explaining an example of a scanning feedback part 240 shown in FIG. 1.

Referring to FIGS. 1 and 3, a scanning feedback part 240 includes a current sensing part 410, an analog-digital converter 420, a minimum value selecting part 430, a digital-analog converter 440 and a feedback part 450.

The current sensing part 410 senses string currents of the LED strings flowing through the sensing resistor 242, and provides the analog-digital converter 420 with the sensed string currents.

The analog-digital converter 420 converts the sensed currents into digital sensed currents.

The minimum value selecting part 430 selects a minimum string current of the digital sensed currents.

The digital-analog converter 440 converts the selected minimum string current into an analog string current.

The feedback part 450 adjusts a level of a driving voltage VIN outputted from the voltage generating part 220 based on the analog string current, so that a constant voltage is controlled.

Figure 4:
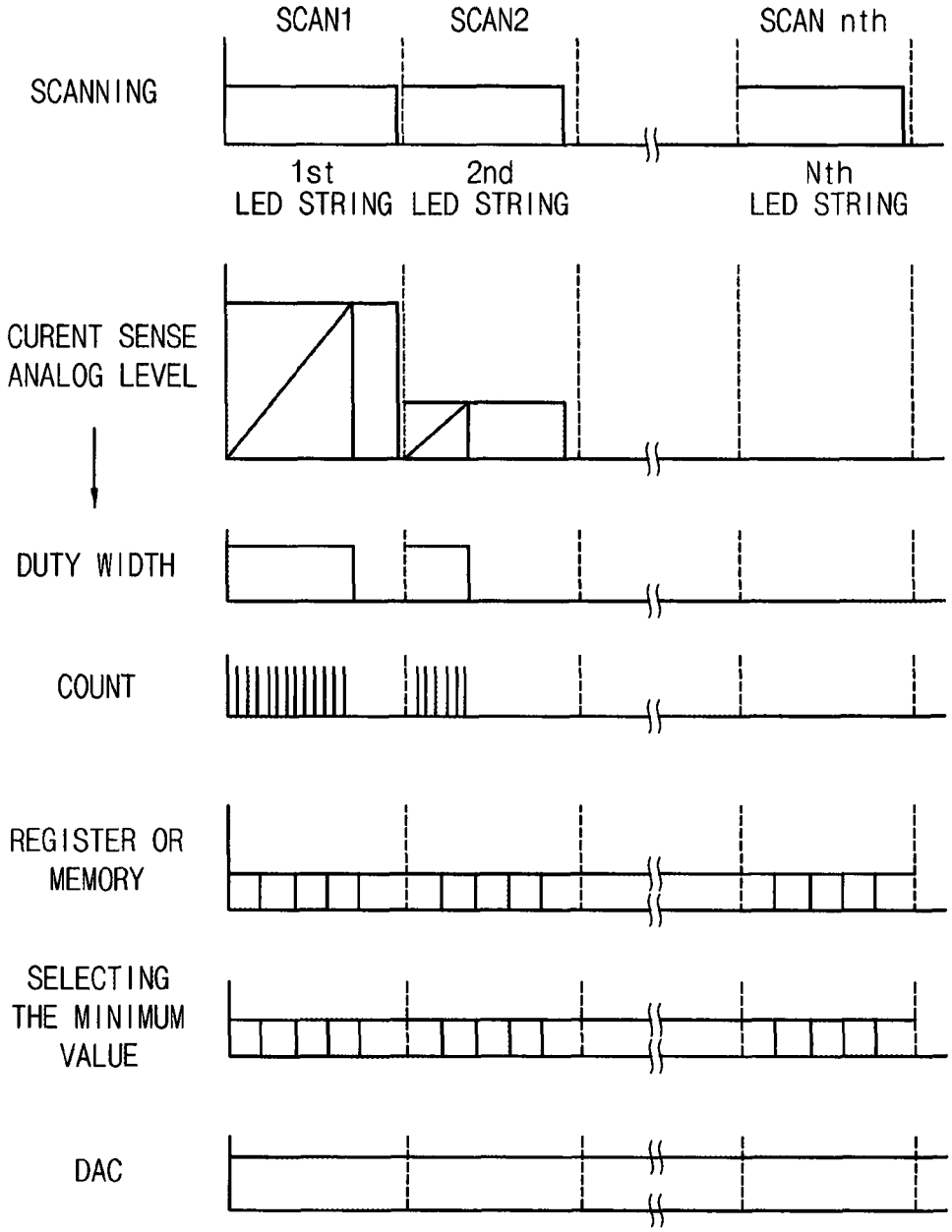
FIG. 4 is a waveform diagram explaining an example of an operation of a scanning feedback part shown in FIG. 3.

FIG. 4 is a waveform diagram explaining an example of an operation of a scanning feedback part 240 shown in FIG. 3. Particularly, FIG. 4 is a waveform diagram explaining a method of selecting the minimum feedback current information by a digital calculation.

Referring to FIG. 4, LED strings are sequentially selected to be activated. In this case, the meaning of "LED strings are activated" refers to that a current is supplied to the LED strings.

When the first LED string is activated, a string current is provided to the first LED string so that it is regulated at a normal current level. Then, when the second LED string is activated, a string current is provided to the second LED string so that it is regulated at a normal current level. In FIG. 4, the normal current regulated at the second LED string is smaller than the normal current regulated at the first LED string.

A current regulated at the first LED string is converted into digital data to have a value with a first duty width, and a current regulated at the second LED string is converted into digital data to have a value with a second duty width. In this case, the second duty width is smaller than the first duty width.

Each of the first duty width and the second duty width is counted, and counted values are stored in a register or a memory. Since the second duty width is smaller than the first duty width, a count value corresponding to the second duty width is smaller than a count value corresponding to the first duty width. In this case, the count values may be defined in 8 bits.

Count values stored in a register or a memory are a count value corresponding to the first duty width and a count value corresponding to a second duty width. The minimum value is selected from the count values. A count value corresponding to the selected minimum value is converted into an analog signal.

Figure 5:
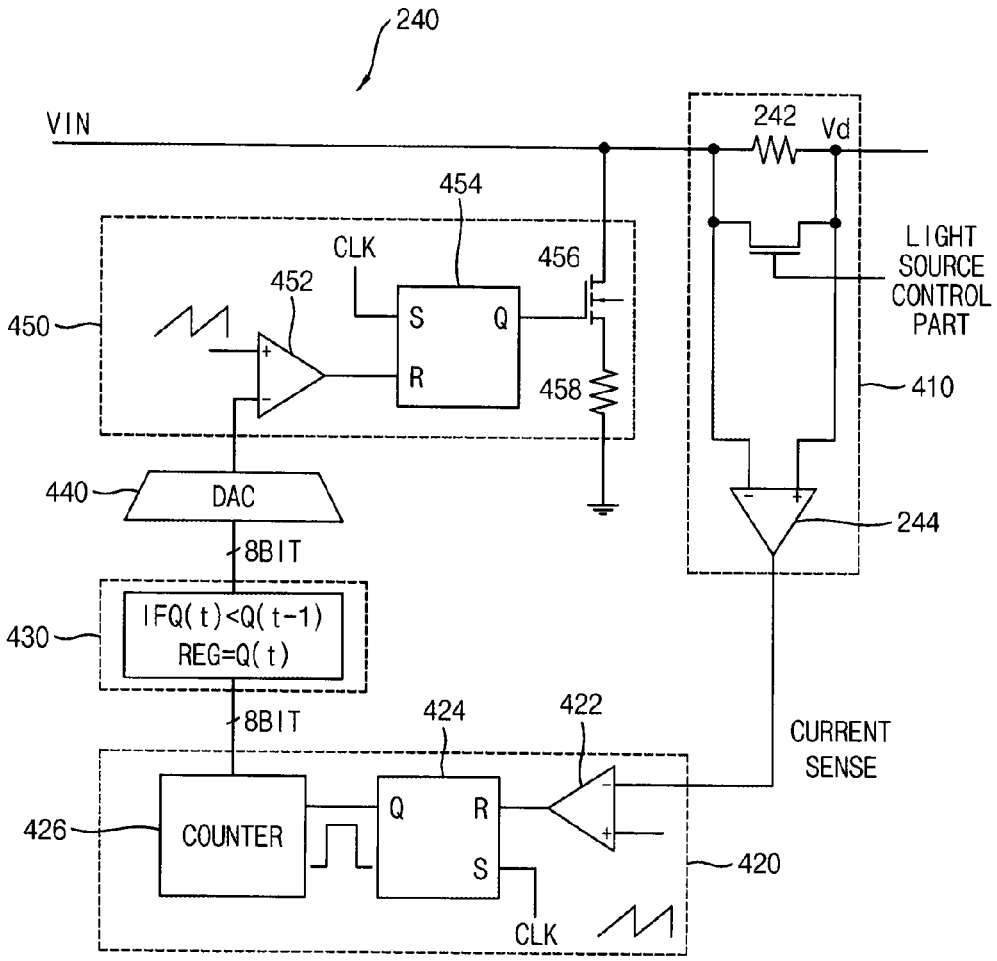
FIG. 5 is a block diagram explaining an example of a scanning feedback part shown in FIG. 3.

FIG. 5 is a block diagram explaining an example of a scanning feedback part 240 shown in FIG. 3.

Referring to FIGS. 3 and 5, a scanning feedback part 240 includes a current sensing part 410, an analog-digital converter 420, a minimum value selecting part 430, a digital-analog converter 440 and a feedback part 450.

The current sensing part 410 includes a sensing resistor 242 and a second differential amplifier 244 connected to two terminals of the sensing resistor 242. The current sensing part 410 senses a string current flowing the sensing resistor 242 to output the sensed string current to the analog-digital converter 420.

The second differential amplifier 244 includes a inverting input receiving a voltage corresponding to a current inputted through the sensing resistor 242, a non-inverting input receiving a voltage corresponding to a current outputted from the sensing resistor 242 and an output terminal outputting an amplified different voltage to the analog-digital converter 420.

The analog-digital converter 420 includes a first error amplifier 422, a first RS flip-flop 424 and a counter 426. The analog-digital converter 420 digitally converts the sensed current into a digital sensed current to provide the minimum value selecting part 430 with the digital sensed current.

The first error amplifier 422 includes a inverting input connected to an output terminal of the second differential amplifier 244, a non-inverting input connected to a saw wave generating part (not shown) generating a saw wave, and an output terminal connected to a reset terminal of the first RS flip-flop 424.

The first RS flip-flop 424 includes a reset terminal connected to an output terminal of the first error amplifier 422, a set terminal receiving a clock signal, and a Q terminal connected to the counter 426.

The counter 426 counts a status signal outputted from the first RS flip-flop 424 to output a count value, for example, a count value of 8 bits to the minimum value selecting part 430.

The minimum value selecting part 430 selects the minimum string current data of the digital converted current data. In an exemplary embodiment, the minimum value selecting part 430 compares with a previous 8 bits count value Q(t-1) and a current 8 bits count value Q(t) to obtain a small 8 bit count value, and provides the digital-analog converter 440 with the small 8 bit count value.

The digital-analog converter 440 is connected to an output terminal of the minimum value selecting part 430. The digital-analog converter 440 converts the minimum string current into an analog string current, and provides the feedback part 450 with the analog string current.

The feedback part 450 includes a second error amplifier 452, a second RS flip-flop 454, a second power MOSFET 456 and a pull-down resistor 458 to control the constant voltage based on an analog converted current.

The second error amplifier 452 includes a inverting input connected to an output terminal of the digital-analog converter 440, a non-inverting input connected to a saw wave generating part (not shown) generating a saw wave, and an output terminal connected to a reset terminal of the second RS flip-flop 454.

The second RS flip-flop 454 includes a reset terminal connected to an output terminal of the second error amplifier 452, a set terminal receiving a clock signal, and a Q terminal connected to the second power MOSFET 456.

The second power MOSFET 456 includes a gate connected to a Q terminal of the second RS flip-flop 454, a source connected to a first terminal of the pull-down resistor 458 and a drain connected to an input terminal of the sensing resistor 242.

The pull-down resistor 458 includes a first terminal connected to a source of the second power MOSFET 456 and a second terminal connected to a ground terminal As described above, according to an inventive concept, a drain-source voltage of a second power MOSFET equipped in a scanning feedback part disposed between a voltage generating part and an LED string is adjusted to regulate an LED current. Thus, the drain-source voltage of the second power MOSFET disposed between the voltage generating part and the LED string is directly adjusted, so that a luminance is not decreased.

Figure 6:
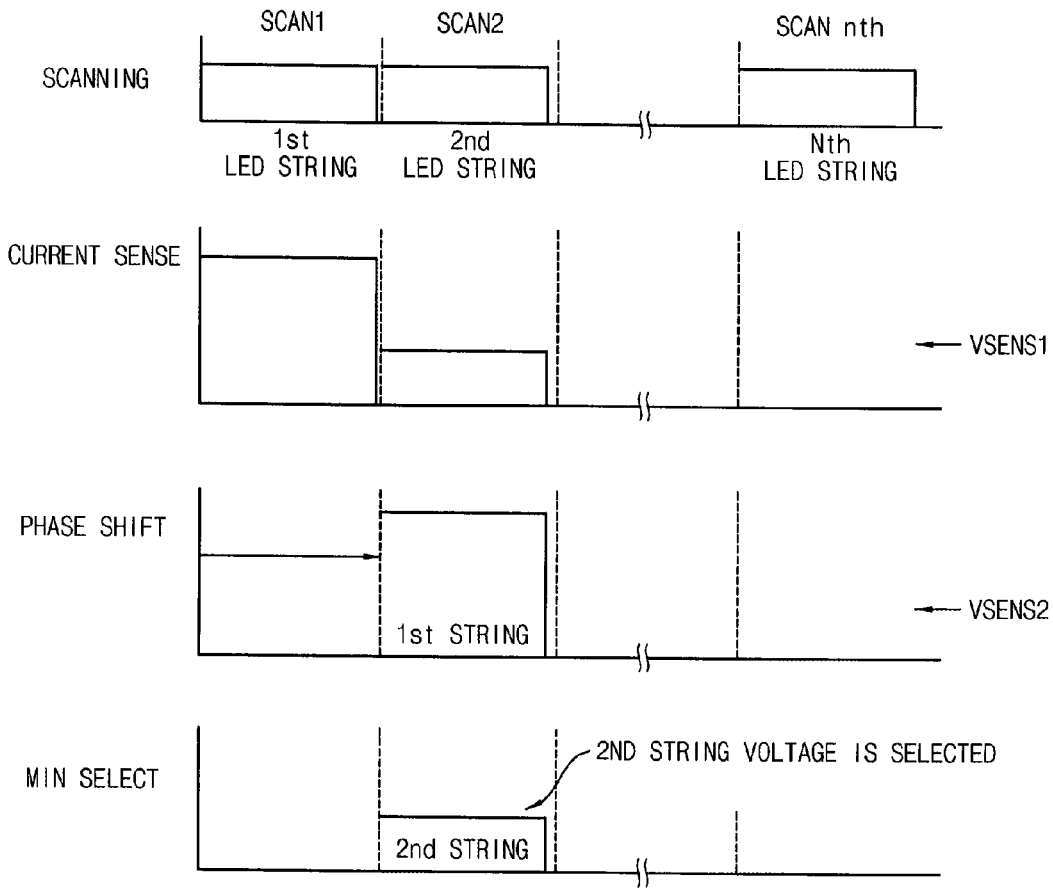
FIG. 6 is a waveform diagram explaining another example of an operation of a scanning feedback part shown in FIG. 1.

FIG. 6 is a waveform diagram explaining another example of an operation of a scanning feedback part 240 shown in FIG. 1. Particularly, FIG. 6 is a waveform diagram explaining a method of selecting the minimum feedback current information by shifting a phase difference of a sensing voltage.

Referring to FIGS. 1 and 6, LED strings are sequentially selected to be activated. In this case, the meaning of "LED strings are activated" refers to that a current is supplied to the LED strings.

A string current flowing through a first LED string is sensed in a first scanning, and then a string current flowing through a second LED string is sensed in a second scanning. The sensed string currents are defined as a first sensing voltage Vsens1.

A phase of a voltage sensed by the first scanning is shifted by a ½ frame frequency. A voltage having a shifted phase is defined as a second sensing voltage Vsens2. That is, a phase of a first sensing voltage Vsens1 is shifted to have a same phase of the second sensing voltage Vsens2.

The first sensing voltage Vsens1 and the second sensing voltage Vsens2 are compared with each other, so that a low voltage is selected. A voltage selected in FIG. 6 is a voltage corresponding to a string current flowing through a second LED string. That is, the string current flowing through the second LED string may be the minimum feedback current information.

Having described exemplary embodiments of the inventive concept, it is further noted that it is readily apparent to those of reasonable skill in the art that various modifications may be made without departing from the spirit and scope of the inventive concept which is defined by the metes and bounds of the appended claims.

What is claimed is:

1. A light source device comprising:

a plurality of light-emitting diode ("LED") strings in which LEDs emitting lights are connected in serial; and an LED driving circuit configured to supply a driving voltage to the LED strings, the LED driving circuit configured to maximize the driving voltage supplied to the LED strings by using the minimum string current of string currents supplied to each LED string in an initial driving period, and configured to supply the maximum driving voltage to the LED strings by blocking a current flowing through a sensing resistor disposed to sense the minimum string current in a normal driving period.

2. The light source device of claim 1, wherein the LED driving circuit comprises:

a voltage generating part configured to provide each first terminal of the LED strings with the driving voltage;

a string selecting part connected to each second terminal of the LED strings to sequentially select the LED string; and a scanning feedback part configured to detect string currents supplied to each of the LED strings sequentially selected and configured to control the voltage generating part to output the maximum driving voltage by using the minimum string current.

3. The light source device of claim 2, wherein the string selecting part include a plurality of string selecting portions, each string selecting portion comprises:

a first differential amplifier;

a first metal-oxide-semiconductor field effect transistor ("MOSFET") comprising a gate connected to an output terminal of the first differential amplifier, a source connected to a ground terminal, and a drain connected to the LED string;

a voltage storage part configured to store drain voltage information of the first MOSFET;

a voltage storage control part configured to control that the drain voltage information of the MOSFET is stored in the voltage storing part in an initial driving period; and a reference voltage setting part configured to set drain voltage information of the first MOSFET as a new reference voltage, which is stored in the voltage storing part in a normal driving period.

4. The light source device of claim 3, wherein the voltage storage control part comprises:

a first field effect transistor ("FET") comprising a drain receiving a sensing current, a gate receiving a scanning control signal provided from a light source control part, and a source connected to an inverting input of the differential amplifier, the first FET configured to supply a voltage corresponding to a sensing current to the inverting input of the first differential amplifier in response to a scanning control signal of a high level;

a second FET comprising a source connected to the reference voltage setting part, a drain commonly connected to a second terminal of the LED string and a drain of the first MOSFET, and a gate receiving the scanning control signal, the second FET configured to store drain voltage information of the first MOSFET in the voltage storing part in response to a scanning control signal of a high level; and a third FET comprising a drain receiving an initial reference voltage provided from the light source control part, a gate receiving the scanning control signal, and a source connected to a non-inverting input of the first differential amplifier, the third FET configured to supply the initial reference voltage to the non-inverting input of the first differential amplifier in response to a scanning control signal of a high level.

5. The light source device of claim 4, wherein the reference voltage setting part comprises:

a fourth FET comprising a drain commonly connected to a source of the first FET and the inverting input of the first differential amplifier, a source connected to the source of the second FET, and a gate connected to an output terminal of a first inverter;

a fifth FET comprising a source commonly connected to the source of the third FET and the non-inverting input of the first differential amplifier, and a drain commonly connected to the drain of the second FET, the second terminal of the LED string and the drain of the first MOSFET;

a first inverter inverting the scanning control signal and outputting the inverted scanning control signal to a gate of the fourth FET; and a second inverter inverting the scanning control signal and outputting the inverted scanning control signal to the gate of the fifth FET.

6. The light source device of claim 5, when the scanning control signal is a low level, wherein a signal of a high level inverted by the first inverter turns-on the fourth FET, so that a voltage stored in the voltage storing part is supplied to the inverting input of the first differential amplifier.

7. The light source device of claim 5, when the scanning control signal is a low level, wherein a signal of a high level inverted by the second inverter turns-on the fifth FET, so that a drain voltage of the first MOSFET is supplied to the non-inverting input of the first differential amplifier.

8. The light source device of claim 2, wherein the sensing resistor is disposed between the voltage generating part and the LED string to convert amplitude of a current into a voltage, and wherein the scanning feedback part comprises a second differential amplifier, inputs of the second differential amplifier being connected to two terminals of the sensing resistor to amplify a difference voltage between a voltage outputted from the voltage generating part and a voltage passing the sensing resistor and to control the voltage generating part to output the maximum voltage by using the amplified difference voltage.

9. The light source device of claim 8, wherein the scanning feedback part further comprises a switch connected to the two terminals of the sensing resistor to be opened before a normal current is respectively supplied to the LED strings and to be closed when the normal current is respectively supplied to the LED strings, wherein a driving voltage outputted from the voltage generating part is supplied to the LED strings through the sensing resistor during an initial driving period which is a period for detecting a current value of each LED string before a normal driving period, and the driving voltage outputted from the voltage generating part is supplied to the LED strings through the switch during the normal driving period to cause the LED strings to turn-on to emit light.

10. The light source device of claim 2, wherein the scanning feedback part comprises:

a current sensing part configured to sense string currents supplied to the LED strings from the voltage generating part;

an analog-digital converter configured to convert the currents sensed by the current sensing part into digital sensed currents;

a minimum value selecting part configured to select a minimum string current of the digital sensed currents;

a digital-analog converter configured to convert the minimum string current selected by the minimum value selecting part into an analog string current; and a feedback part configured to adjust a level of a driving voltage outputted from the voltage generating part, based on the analog string current converted by the digital-analog converter, to control a constant voltage.

11. The light source device of claim 10, wherein the sensing resistor is disposed between the voltage generating part and the LED string to convert amplitude of a current into a voltage, and wherein the current sensing part comprises a second differential amplifier comprising an inverting input receiving a voltage corresponding to a current inputted through the sensing resistor, a non-inverting input receiving a voltage corresponding to a current outputted from the sensing resistor and an output terminal outputting an amplified differential voltage to the analog-digital converter.

12. The light source device of claim 10, wherein the analog-digital converter comprises:

a first error amplifier comprising an inverting input connected to an output terminal of the second differential amplifier and a non-inverting input receiving a saw tooth waveform signal;

a first RS flip-flop comprising a reset terminal connected to an output terminal of the first error amplifier and a set terminal receiving a clock signal; and a counter counting a status signal outputted from the first RS flip-flop to output a count value to the minimum value selecting part.

13. The light source device of claim 10, wherein the minimum value selecting part compares with a previous count value and a current count value to provide the digital-analog converter with a minimum count value.

14. The light source device of claim 10, wherein the feedback part comprises:

a second error amplifier comprising an inverting input connected to an output terminal of the digital-analog converter, and a non-inverting input receiving a saw tooth waveform signal;

a second RS flip-flop comprising a reset terminal connected to an output terminal of the second error amplifier, and a set terminal receiving a clock signal;

a second MOSFET comprising a gate connected to Q terminal of the second flip-flop and a drain connected to the voltage generating part; and a pull-down resistor comprising a first terminal connected to a source of the second MOSFET and a second terminal connected to a ground terminal.

15. A method of driving a light source device comprising a voltage generating part and a plurality of light-emitting diode ("LED") strings in which LEDs emitting lights in response to an output voltage of the voltage generating part are connected in serial, the method comprising:

in an initial driving period, maximizing a driving voltage supplied to the LED strings by using a minimum string current information of string currents respectively supplied to the LED strings; and in a normal driving period, blocking a current flowing through a sensing resistor disposed to sense the minimum string current to supply the maximum driving voltage to the LED strings.

16. The method of claim 15, wherein the maximizing the driving voltage comprises:

regulating each of the LED strings at a normal current to obtain feedback current information;

selecting the minimum feedback current information of the feedback current information; and fixing an output voltage of the voltage generating part in response to the minimum feedback current information.

17. The method of claim 16, wherein the maximizing the driving voltage further comprises:

regulating each of the LED strings to a normal current in accordance with the fixed output voltage and obtaining feedback current information;

selecting the minimum feedback current information of the obtained feedback current information; and fixing an output voltage of the voltage generating part based on the selected minimum feedback current information.

18. The method of claim 16, wherein each string current of the LED strings regulated to a normal current is converted into string current data of a digital value, and wherein the minimum feedback current information is selected from the plural string current data.

19. The method of claim 16, wherein the minimum feedback current information is selected by comparing with a first sensing voltage corresponding to a string current of N-th LED string and a second sensing voltage corresponding to a string current of (N+1)-th LED string, wherein 'N' is a natural number, and wherein a phase of the first sensing voltage is shifted to have a same phase of the second sensing voltage.

20. A display device comprising:

a display panel; and a light source device configured to provide the display panel with lights, the light source device comprising:

a plurality of light-emitting diode ("LED") strings in which LEDs emitting lights are connected in serial; and an LED driving circuit configured to supply a driving voltage to the LED strings, the LED driving circuit configured to maximize the driving voltage supplied to the LED strings by using the minimum string current of string currents supplied to each LED string in an initial driving period, and configured to supply the maximum driving voltage to the LED strings by blocking a current flowing through a sensing resistor disposed to sense the minimum string current in a normal driving period.

* * * * *